US006527535B1

(12) United States Patent
Han

(10) Patent No.: US 6,527,535 B1
(45) Date of Patent: Mar. 4, 2003

(54) MANUAL DIE SET FOR PRESSING EXPLOSIVE POWDER INTO HOLLOW CYLINDRICAL PELLETS

(75) Inventor: Philip S. Han, Issue, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 370 days.

(21) Appl. No.: 09/625,847

(22) Filed: Jul. 26, 2000

(51) Int. Cl.[7] ..... B30B 11/04

(52) U.S. Cl. ..... 425/185; 425/193; 425/412; 425/422; 425/DIG. 15; 264/3.1

(58) Field of Search ..... 425/412, 78, DIG. 15, 425/422, 443, 185, 193; 264/3.1

(56) References Cited

U.S. PATENT DOCUMENTS 3,158,547 A * 11/1964 Smith ..... 425/352
3,640,654 A 2/1972 Smith ..... 425/78
3,671,164 A 6/1972 Hara et al. ..... 425/414
3,790,330 A * 2/1974 Roland ..... 425/412
4,157,887 A * 6/1979 Sothje ..... 425/412
4,573,895 A 3/1986 DeSantis et al. ..... 425/78
5,039,292 A 8/1991 Taniwaga ..... 425/78
5,277,570 A * 1/1994 Siggers ..... 425/422
6,261,082 B1 * 7/2001 Han ..... 425/412

* cited by examiner

*Primary Examiner*—Jan H. Silbaugh
*Assistant Examiner*—Thu Khanh T. Nguyen
(74) *Attorney, Agent, or Firm*—Mark Homer

(57) ABSTRACT

A manual die set includes a ram, the ram defining a bore therethrough; a die, the die defining a bore therethrough for reciprocably receiving the ram; a baseplate having an upper portion and a lower portion and defining a bore therethrough, the upper portion of the baseplate being disposed in a bottom of the die bore, the lower portion of the baseplate supporting the die; a knockout ring for supporting the die; a supporting block disposed in an interior of the knockout ring, for supporting the baseplate when the manual die set is in a pressing configuration, the supporting block defining a bore therethrough; and a mandrel, the mandrel being disposed in the ram bore, the baseplate bore and the supporting block bore when the manual die set is in a pressing configuration, the mandrel including an upper large diameter portion, a transition portion and a lower small diameter portion.

17 Claims, 3 Drawing Sheets

MANUAL DIE SET FOR PRESSING EXPLOSIVE POWDER INTO HOLLOW CYLINDRICAL PELLETS

STATEMENT OF GOVERNMENT INTEREST

The invention described herein may be manufactured and used by or for the Government of the United States of America for government purposes without the payment of any royalties therefor.

BACKGROUND OF THE INVENTION

The invention relates in general to manual die sets for pressing explosive powder and in particular to manual die sets for pressing explosive powder into hollow cylindrical pellets.

Manual die sets for pressing explosive powder into hollow cylindrical pellets are known. The explosive powder is a highly sensitive explosive molding powder, for example, PBXN-9 or PBXW-11. The manual die set, in combination with a press for supplying the pressing force, presses the explosive powder into hollow cylindrical (donut-shaped) pellets.

FIG. 1 is an elevation view, partially in cross-section, of a known manual die set 10 in a press configuration. FIG. 2 is an elevation view, partially in cross-section, of the die set 10 in a first knockout configuration. FIG. 3 is an elevation view, partially in cross-section, of the die set 10 in a second knockout configuration.

Referring to FIG. 1, manual die set 10 is used to press highly sensitive explosive molding powder into a hollow cylindrical pressed pellet 24 in the following manner. First, the baseplate 22 is fitted into the opening 20 in the bottom of the die 18. A mandrel 16 is inserted in the die opening 20 and into the opening 26 in the baseplate 22. The required amount of molding powder is poured into the die opening 20. Next, the ram 12 with opening 14 is inserted into the top of the die opening 20 and mandrel 16 is inserted into opening 14 in the ram. Pressing force is applied by a press (not shown) to the top of ram 12 until the pellet 24 is formed.

Referring to FIG. 2, the die set 10 is manually turned upside down and placed on a first or mandrel knockout ring 28. An ejector guide 30 having an opening 31 therein is placed on top of baseplate 22 and die 18. A mandrel ejector 32 is inserted in the opening 31 in the ejector guide 30. Pressing force is applied by a press to the top of mandrel ejector 32 so that the mandrel ejector 32 moves downwardly to force the mandrel 16 out of the die set 10. Mandrel ejector 32 and ejector guide 30 are then removed.

Referring to FIG. 3, the manual die set 10 is removed from the mandrel knockout ring 28 of FIG. 2, again turned upside down and then placed on a second or pellet knockout ring 34. Pressing force is applied by a press to the top of ram 14. Ram 14 moves downwardly, ejecting the baseplate 22 (if not already removed manually) and the explosive pellet 24. Ram 14 stops when it contacts the top of die 18.

The process described above requires many time-consuming steps. Die set 10 must be turned upside down twice with the explosive pellet contained therein. The manual die set 10 also includes many pieces of tooling. Only well experienced technicians can handle the die set 10, because of safety concerns associated with turning the die set upside down twice with the explosive pellet therein. Thus, a need exists for a manual die set that overcomes the problems of the manual die set of FIGS. 1–3.

SUMMARY OF THE INVENTION

In one embodiment, the present invention provides a manual die set comprising a ram, the ram defining a bore therethrough; a die, the die defining a bore therethrough for reciprocably receiving the ram; a baseplate having an upper portion and a lower portion and defining a bore therethrough, the upper portion of the baseplate being disposed in a bottom of the die bore, the lower portion of the baseplate supporting the die; a knockout ring for supporting the die; a supporting block disposed in an interior of the knockout ring, for supporting the baseplate when the manual die set is in a pressing configuration, the supporting block defining a bore therethrough; and a mandrel, the mandrel being disposed in the ram bore, the baseplate bore and the supporting block bore when the manual die set is in a pressing configuration, the mandrel including an upper large diameter portion, a transition portion and a lower small diameter portion.

Preferably, a diameter of the upper large diameter portion of the mandrel is about 0.050 inches larger than a diameter of the lower small diameter portion of the mandrel. More preferably, the transition portion of the mandrel is disposed in the baseplate bore in the lower portion of the baseplate, when the manual die set is in a pressing configuration.

The manual die set further comprises explosive molding powder disposed in the die bore between the ram and the upper portion of the baseplate, when the manual die set is in a pressing configuration.

The supporting block includes a channel extending from the supporting block bore to an outer surface of the supporting block, the channel having a width at least as large as a diameter of the supporting block bore. The knockout ring includes an opening having a width greater than a diameter of the supporting block such that the supporting block is removable from the interior of the knockout ring via the opening in the knockout ring.

In a preferred embodiment, the ram includes an opening in a top portion thereof, the manual die set further comprising an air cap disposed in the opening in the top portion of the ram, the air cap including a passage therein for air flow from the ram bore, the air cap defining a groove formed therein, the manual die set further comprising an O-ring disposed in the groove in the air cap. The ram includes at least one air passage in a lower portion thereof, the at least one air passage extending from the ram bore to an external surface of the ram.

The supporting block includes a second channel formed in a bottom portion thereof, the second channel extending from a point beyond the supporting block bore, in a direction opposite from a direction of the first channel, to the outer surface of the supporting block.

The lower small diameter portion of the mandrel includes an undercut formed therein, the undercut being located in the second channel of the supporting block, the manual die set further comprising a lock which is removably inserted in the second channel to engage the undercut in the mandrel thereby preventing vertical motion of the mandrel.

Another aspect of the invention is a method of pressing hollow cylindrical pellets comprising pouring explosive molding powder into a die bore; pressing a ram a first time to compress the explosive molding powder between the ram and a baseplate to form a pellet; removing a supporting block from the manual die set via an opening in a knockout ring; pressing the ram again to eject the pellet from the die; lifting the die from the knockout ring until a bottom of a mandrel is above the pellet; and removing the pellet from an interior of the knockout ring.

Further objects, features and advantages of the invention will become apparent from the following detailed description taken in conjunction with the following drawing.

BRIEF DESCRIPTION OF THE DRAWING

Throughout the Figures, reference numerals that are the same refer to the same features.

DETAILED DESCRIPTION OF THE PREFERRED EMBODIMENTS

The present invention is a manual die set and process for pressing explosive powder into hollow cylindrical pellets. The invention reduces the number of steps required to produce a hollow cylindrical pellet, thereby allowing the production rate to be increased possibly as much as 400%. Also, because less tooling is needed, the tooling cost is reduced.

Figure 3:
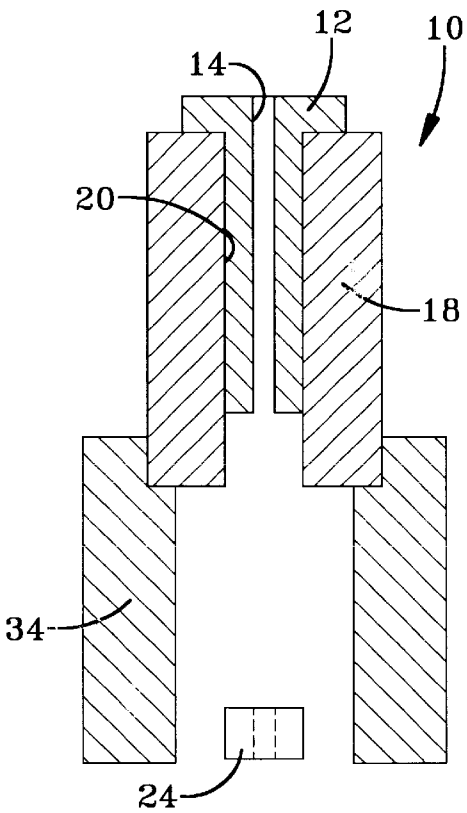
FIG-3 PRIOR ART
FIG. 3 is an elevation view, partially in cross-section, of a known manual die set in a second knockout configuration.
Figure 2:
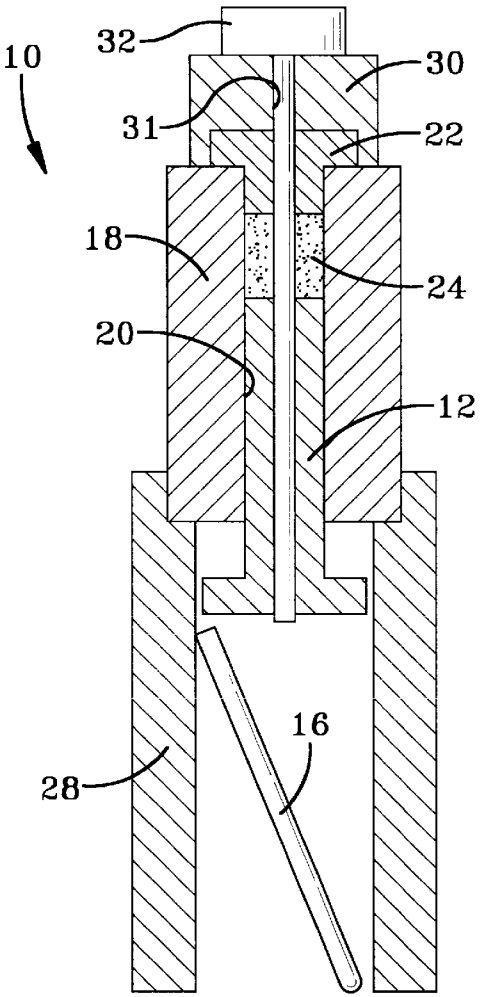
FIG-2 PRIOR ART
FIG. 2 is an elevation view, partially in cross-section, of a known manual die set in a first knockout configuration.
Figure 1:
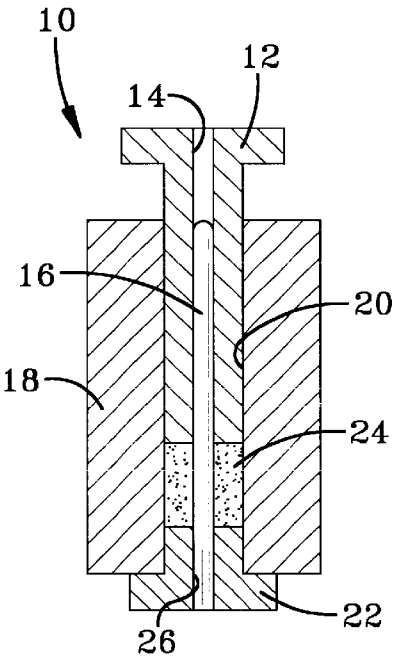
FIG-1 PRIOR ART
FIG. 1 is an elevation view, partially in cross-section, of a known manual die set in a press configuration.
Figure 5:
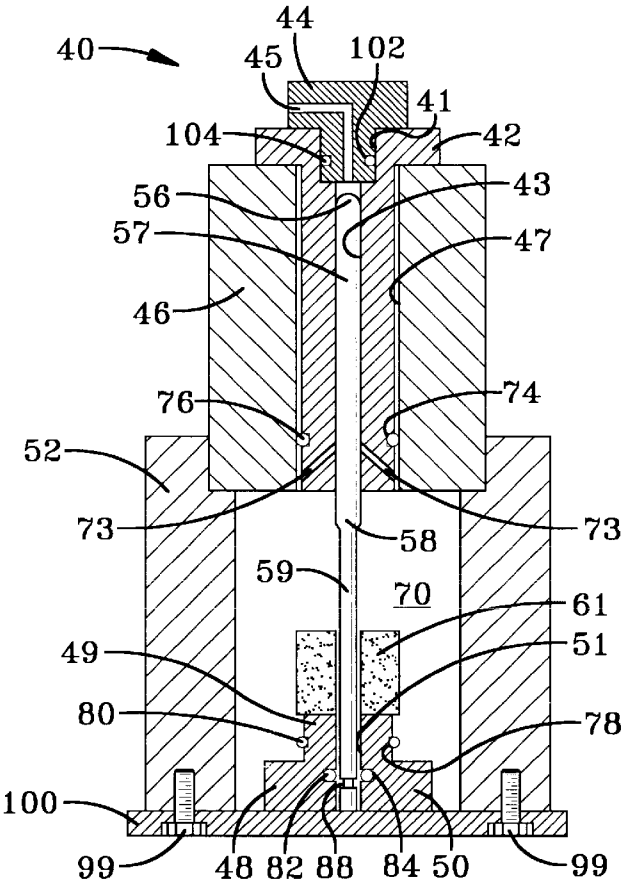
FIG. 5 is an elevation view, partially in cross-section, of the manual die set of FIG. 4, in a knockout configuration.
Figure 4:
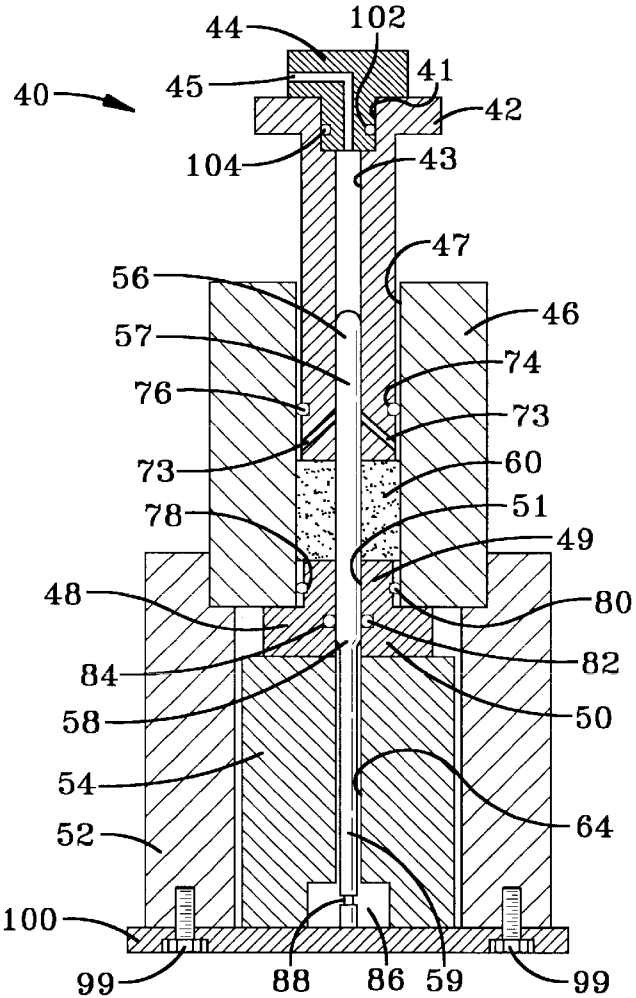
FIG. 4 is an elevation view, partially in cross-section, of an embodiment of a manual die set in accordance with the invention, in a press configuration.

FIG. 4 is an elevation view, partially in cross-section, of an embodiment of a manual die set 40 in accordance with the invention, in a press configuration. FIG. 5 is an elevation view, partially in cross-section, of the manual die set 40 of FIG. 4, in a knockout configuration. The manual die set 40 includes a ram 42, a die 46, a baseplate 48, a knockout ring 52, a supporting block 54 and a mandrel 56, all made of hardened tool steel. A conventional press, for example, a hydraulic press (not shown) is used to provide the pressing force against the head of the ram 42. Depending on the size of the manual die set 40, the press may be a 100 to 200 ton press. The ram 42 receives between about 15 and 30 kpsi of pressing force.

The ram 42 defines a bore 43 therethrough. The die 46 defines a bore 47 therethrough for reciprocably receiving the ram 42. Baseplate 48 defines a bore 51 therethrough. Baseplate 48 includes an upper portion 49 and a lower portion 50. The upper portion 49 of the baseplate 48 is disposed in a bottom of the die bore 47 in the pressing configuration. The lower portion 50 of the baseplate 48 supports the die 46 in the pressing configuration. Knockout ring 52 supports the die 46. The supporting block 54 is disposed in an interior 70 of the knockout ring 52, for supporting the baseplate 48 in the pressing configuration. The supporting block 54 defines a bore 64 therethrough.

In the pressing configuration, the mandrel 56 is disposed in the ram bore 43, the baseplate bore 51 and the supporting block bore 64. The mandrel 56 extends to the bottom of the supporting block 54. Mandrel 56 is stationary during the pressing operation. Mandrel 56 includes an upper large diameter portion 57, a transition portion 58 and a lower small diameter portion 59. An important feature of the present invention is that the diameter of the upper large diameter portion 57 of the mandrel is about 0.050 inches larger than the diameter of the lower small diameter portion 59 of the mandrel 56. In the pressing configuration, the transition portion 58 of the mandrel 56 is disposed in the baseplate bore 51 in the lower portion 50 of the baseplate 48.

In the pressing configuration, explosive molding powder, such as PBXN-9 or PBXW-11, is disposed in the die bore 47 between the ram 42 and the upper portion 49 of the baseplate 48.

Figure 6A:
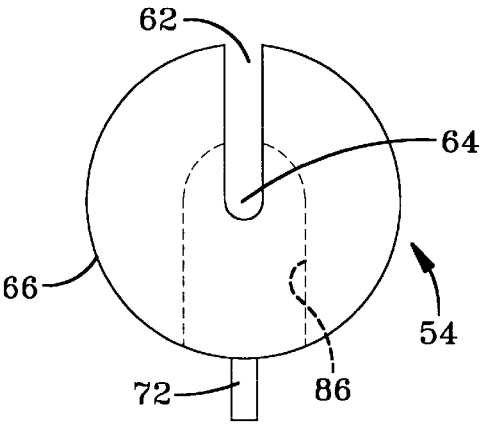
FIG. 6(A) is a top view of a supporting block.
Figure 6B:
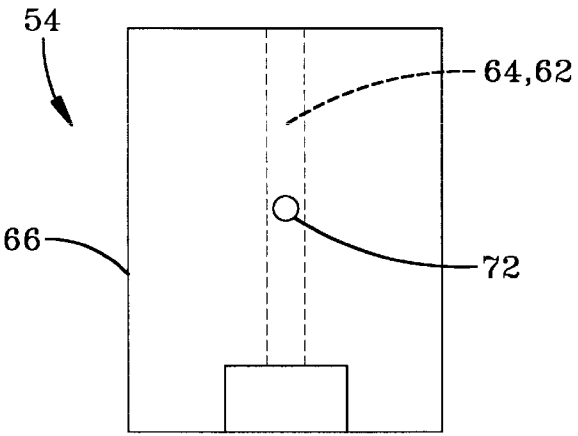
FIG. 6(B) is an elevation view of the supporting block of FIG. 6(A).

As best seen in FIGS. 6(A) and (B), the supporting block 54 includes a channel 62 extending from the supporting block bore 64 to an outer surface 66 of the supporting block 54. The channel 62 has a width at least as large as the diameter of the supporting block bore 64. The supporting block 54 includes a handle 72 attached to the outer surface 66 of the supporting block 54. The handle 72 is preferably attached to the supporting block 54 about 180 degrees from the channel 62 in the supporting block 54. Handle 72 may be, for example, a cylindrical piece of tool steel that is threaded into a threaded opening in the supporting block. Of course, many other types of handles 72 are possible.

Figure 7:
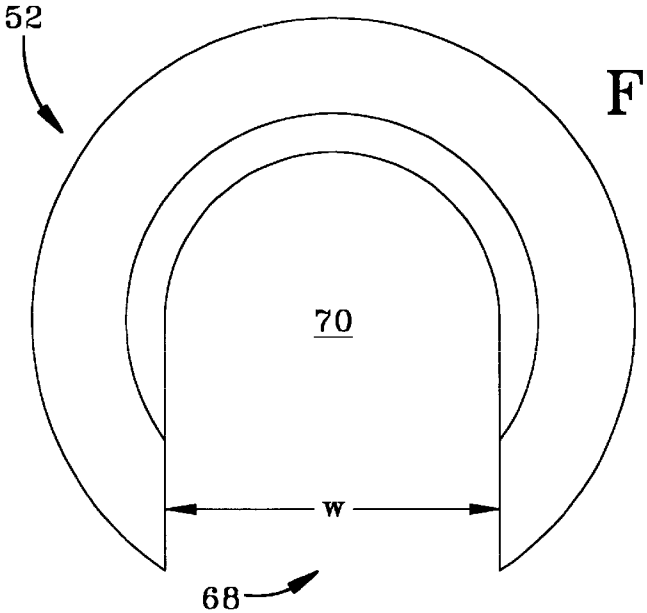
FIG. 7 is a top view of a knockout ring.

As best seen in FIG. 7, the knockout ring 52 includes an opening 68 having a width w that is greater than the diameter of the supporting block 54. Therefore, the supporting block 54 is removable from the interior 70 of the knockout ring 52 via the opening 68 in the knockout ring. Knockout ring 52 may also be fixed to a platen 100 (FIGS. 4 and 5) by, for example, bolts 99.

The manual die set 40 may be used either with or without a vacuum applied to the die bore 47 during pressing of the explosive molding powder. If needed for a particular application, the vacuum is between about 2 to 5 mm Hg. For vacuum operation, the ram 42 includes an opening 41 in a top portion thereof and an air cap 44 disposed in the opening 41 in the top portion of the ram 42. The air cap 44 includes a passage 45 therein for air flow from the ram bore 43. A conventional vacuum pump and hose (not shown) is connected to the passage 45. For sealing between the air cap 44 and the ram 42, the air cap 44 includes a groove 102 formed therein and an elastomeric O-ring 104 disposed in groove 102.

The ram 42 further includes at least one air passage 73 in a lower portion thereof. The at least one air passage 73 extends from the ram bore 43 to the die bore 47. Preferably, the at least one air passage 73 comprises four air passages 73 disposed about ninety degrees apart around the ram 42. For sealing the upper end the die bore 47, the external surface of the ram 42 includes a groove 74 formed therein at a location above a location where the at least one air passage 73 intersects the external surface of the ram 42. An elastomeric O-ring 76 is disposed in the groove 74 in the external surface of the ram 42.

For sealing the lower portion of the die bore 47, the upper portion 49 of the baseplate 48 includes a groove 78 formed therein. An elastomeric O-ring 80 is disposed in the groove 78 in the upper portion of the baseplate 48. For sealing the lower portion of the ram bore 43, the baseplate bore 51 in the lower portion 50 of the baseplate 48 includes a groove 82 formed therein. An elastomeric O-ring 84 is disposed in the groove 82 in the baseplate bore 51 in the lower portion of the baseplate 48. Preferably, the transition portion 58 of the mandrel 56 is located below the groove 82 in the baseplate bore 51 in the lower portion 50 of the baseplate 48.

When applying a vacuum, it may be necessary to lock in place the mandrel 56 to prevent it from being "sucked up" vertically in the ram bore 43. To accomplish this, the supporting block 54 includes a second channel 86 (see FIGS. 6(A) and (B)) formed in a bottom portion thereof. The second channel 86 extends from a point beyond the supporting block bore 64, in a direction opposite from the direction of the first channel 62, to the outer surface 66 of the supporting block 54. The lower small diameter portion 59 of the mandrel 56 includes an undercut 88 (FIG. 4) formed therein. The undercut 88 is formed on that part of the mandrel 56 that is located in the second channel 86 of the supporting block 54. A lock 90 (FIG. 8) is removably inserted in; the second channel 86 to engage the undercut 88 in the mandrel 56 thereby preventing vertical motion of the mandrel 56.

Figure 8:
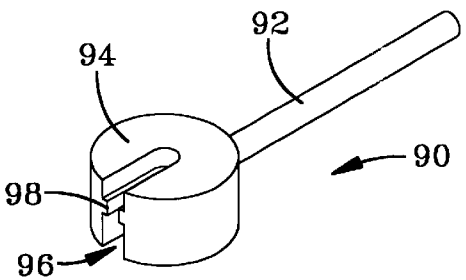
FIG. 8 is a perspective view of a lock.

As shown in FIG. 8, lock 90 includes a handle portion 92 for moving the lock 90 into and out of second channel 86. Locking portion 94 includes a channel 96 formed therein for engaging the mandrel 56. A ridge 98 extends from the locking portion 94 into channel 96 and engages undercut 88 in the mandrel 56, thereby preventing vertical movement of the mandrel 56. Other types of locking mechanisms may, of course, be used, as long as vertical movement of the mandrel 56 is restrained.

The manual die set 40 is operated as follows. Using handle 72, the supporting block 54 is inserted in the interior 70 of the knockout ring 52. Knockout ring 52 may be fixed to platen 100, if desired. Baseplate 48 is placed on supporting block 54. Mandrel 56 is inserted in the baseplate and supporting block bores 51, 64. Die 46 is placed on the knockout ring 52 and baseplate 48 such that the upper portion 49 of the baseplate 48 is disposed in the bottom of die bore 47. For vacuum operation, the lock 90 is inserted in the second channel 86 of supporting block 54 so that ridge 98 of the lock engages undercut 88 of the mandrel 56.

The desired amount of explosive molding powder 60 is poured into the die bore 47. Ram 42 is inserted into die bore 47 and ram bore 43 is guided over mandrel 56. If vacuum operation is desired, a vacuum pump is connected to passage 45 in air cap 44 via a vacuum hose and quick-connect coupling. Ram 42 is pressed a first time to compress the explosive molding powder 60 between the ram 42 and the baseplate 48 to form a pellet 61. The extent of downward travel of ram 42 is governed by the amount of powder 60 used and the desired vertical height of pellet 61. Ram 42 presses powder 60 for a required dwell time.

After pressing, if vacuum was used, the vacuum pump is turned off (returning the die bore 47 to atmospheric pressure) and the lock 90 is removed from mandrel 56 via the second channel 86 in the supporting block 54. The supporting block is then removed from the interior 70 of the knockout ring 52 via the opening 68 in the knockout ring 52. The ram 42 is pressed a second time to eject the pellet 61 (and baseplate 48, if it has not already fallen out due to gravity). The die 46 is then lifted from the knockout ring 52 until the bottom of the mandrel 56 is vertically above the pellet 61. The pellet 61 is removed from the interior 70 of the knockout ring 52. The die 46 is replaced on the knockout ring 52, the baseplate 48 is guided up the mandrel 56 and the supporting block 54 replaced under the baseplate 48. The ram 42 is withdrawn and the process is repeated by pouring powder 60 into the die bore 47.

The dimensions of the manual die set 40 will, of course, vary, depending on the desired size of hollow cylindrical pellet 61. Some exemplary dimensions of one preferred embodiment of the manual die set 40 are as follows: inside diameter of die bore 47, 1.900 inches; outside diameter of ram 42, 0.002 inches less than inside diameter of die bore 47; inside diameter of ram bore 43, 0.442 inches; length of mandrel 56, 13.63 inches; diameter of upper large diameter portion 57 of mandrel 56, 0.391 inches; length of transition portion 58 of mandrel 56, 0.100 inches; diameter of lower small diameter portion 59 of mandrel, 0.341 inches; outside diameter of upper portion 49 of baseplate 48, 0.002 to 0.003 inches smaller than die bore 47; outside diameter of lower portion 50 of baseplate 48, 2.97 inches; diameter of supporting block 54, 3.255 inches; diameter of supporting block bore 64, 0.400 inches; width of supporting block channel 62, 0.400 inches; height of supporting block 54, 4.79 inches; width of supporting block second channel 86, 1.002 inches; diameter of knockout ring 52, 7.000 inches; width w of opening 68 in knockout ring, 3.260 inches.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A manual die set for pressing a material to form a hollow, cylindrical pellet, comprising:

a ram, the ram defining a bore therethrough;

a die, the die defining a bore therethrough for reciprocably receiving the ram;

a baseplate having an upper portion and a lower portion and defining a bore therethrough, the upper portion of the baseplate being disposed in a bottom of the die bore, the lower portion of the baseplate supporting the die;

a knockout ring for supporting the die;

a supporting block, removeable substantially horizontally, disposed in an interior of the knockout ring, for supporting the baseplate when the manual die set is in a pressing configuration, the supporting block defining a bore therethrough; and a mandrel, the mandrel being disposed in the ram bore, the baseplate bore and the supporting block bore when the manual die set is in a pressing configuration, the mandrel including an upper large diameter portion, a transition portion and a lower small diameter portion wherein the upper large diameter portion creates a hole in the cylindrical pellet when pressing with the supporting block and when pressing without the supporting block pushes the material onto the lower small diameter portion which may lift free from the hole to remove the cylindrical pellet.

2. The manual die set of claim 1 wherein a diameter of the upper large diameter portion of the mandrel comprises about 0.050 inches larger than a diameter of the lower small diameter portion of the mandrel.

3. The manual die set of claim 2 wherein the transition portion of the mandrel is disposed in the baseplate bore in the lower portion of the baseplate, when the manual die set is in a pressing configuration.

4. The manual die set of claim 1 further comprising explosive molding powder disposed in the die bore between the ram and the upper portion of the baseplate, when the manual die set is in a pressing configuration.

5. The manual die set of claim 3 wherein the supporting block includes a channel extending from the supporting block bore to an outer surface of the supporting block, the channel having a width at least as large as a diameter of the supporting block bore.

6. The manual die set of claim 5 wherein the knockout ring includes an opening having a width greater than a diameter of the supporting block such that the supporting block is removable from the interior of the knockout ring via the opening in the knockout ring.

7. The manual die set of claim 6 wherein the supporting block includes a handle attached to the outer surface of the supporting block about 180 degrees from the channel in the supporting block.

8. The manual die set of claim 6 wherein the ram includes an opening in a top portion thereof, the manual die set further comprising an air cap disposed in the opening in the top portion of the ram, the air cap including a passage therein for air flow from the ram bore, the air cap defining a groove formed therein, the manual die set further comprising an O-ring disposed in the groove in the air cap.

9. The manual die set of claim 8 wherein the ram includes at least one air passage in a lower portion thereof, the at least one air passage extending from the ram bore to an external surface of the ram.

10. The manual die set of claim 9 wherein the at least one air passage comprises four air passages disposed about ninety degrees apart around the ram.

11. The manual die set of claim 9 wherein the external surface of the ram includes a groove formed therein at a location above a location where the at least one air passage intersects the external surface of the ram, the manual die set further comprising an O-ring disposed in the groove in the external surface of the ram.

12. The manual die set of claim 11 wherein the upper portion of the baseplate includes a groove formed therein, the manual die set further comprising an O-ring disposed in the groove in the upper portion of the baseplate.

13. The manual die set of claim 12 wherein the baseplate bore in the lower portion of the baseplate includes a groove formed therein, the manual die set further comprising an O-ring disposed in the groove in the baseplate bore in the lower portion of the baseplate.

14. The manual die set of claim 13 wherein the transition portion of the mandrel is located below the groove in the baseplate bore in the lower portion of the baseplate.

15. The manual die set of claim 14 wherein the supporting block includes a second channel formed in a bottom portion thereof, the second channel extending from a point beyond the supporting block bore, in a direction opposite from a direction of the first channel, to the outer surface of the supporting block.

16. The manual die set of claim 15 wherein the lower small diameter portion of the mandrel includes an undercut formed therein, the undercut being located in the second channel of the supporting block, the manual die set further comprising a lock which is removably inserted in the second channel to engage the undercut in the mandrel thereby preventing vertical motion of the mandrel.

17. The manual die set of claim 16 further comprising a platen wherein a bottom surface of the knockout ring is fixed to the platen.

* * * * *